United States Patent [19]

Yamamoto et al.

[11] Patent Number: 4,741,863

[45] Date of Patent: May 3, 1988

[54] ALKALINE DEGREASING SOLUTION COMPRISING AMINE OXIDES

[75] Inventors: Tsukasa Yamamoto; Asao Mochizuki, both of Toyota; Yoshikazu Shibata, Okazaki; Hiroshi Okita, Yokosuka; Koichi Ando, Sagamihara; Yasuhiro Okano, Ichikawa; Keiji Hadate, Chiryu, all of Japan

[73] Assignees: Toyota Jidosha Kabushiki Kaisha, Toyota; Nihon Parkerizing Company Limited, Tokyo, both of Japan

[21] Appl. No.: 914,511

[22] Filed: Oct. 2, 1986

Related U.S. Application Data

[63] Continuation of Ser. No. 699,164, Feb. 7, 1985, abandoned.

[30] Foreign Application Priority Data

Feb. 10, 1984 [JP] Japan ..... 59-24104

[51] Int. Cl.[4] ..... C11D 1/75; C11D 3/10

[52] U.S. Cl. ..... 252/547; 134/40; 252/528; 252/DIG. 14; 252/156

[58] Field of Search ..... 134/40; 252/156, 528

[56] References Cited

U.S. PATENT DOCUMENTS

| | | | |
|---|---|---|---|
| 3,223,647 | 12/1965 | Drew et al. | 252/547 X |
| 3,450,637 | 6/1969 | Drew | 252/528 |
| 3,470,102 | 9/1968 | Heinz | 252/528 |
| 3,668,153 | 6/1972 | Crotty | 252/528 |
| 3,740,351 | 6/1973 | Kaplan et al. | 252/547 |
| 3,843,563 | 10/1974 | Davies et al. | 252/547 |
| 4,065,409 | 12/1977 | Flanagan | 252/528 |
| 4,174,304 | 11/1979 | Flanagan | 252/524 |
| 4,276,205 | 6/1981 | Ferry | 252/528 |
| 4,382,825 | 10/1983 | McCready | 134/2 |
| 4,390,465 | 6/1983 | Spekman | 252/527 |
| 4,457,322 | 7/1984 | Rubin et al. | 134/2 |

FOREIGN PATENT DOCUMENTS 2758629 7/1978 Fed. Rep. of Germany .

*Primary Examiner*—Prince E. Willis

*Attorney, Agent, or Firm*—Oblon, Fisher, Spivak, McClelland & Maier

[57] ABSTRACT

This invention relates to an aqueous solution of an alkaline degreasing agent employed for cleaning of metal products surface, and an alkaline degreasing agent employed for making up and replenishing the alkaline degreasing solution.

The essential consituent for these alkaline degreasing solution and agent is a compound, such as an alkyl dimethylamine oxide, a nonionic surface active agent, whose structural formula can be described as follows;

wherein R is an aliphatic hydrocarbon group having the number of carbon atoms 12–22.

The present alkaline degreasing solution can improve degreasing effects without lowering its deforming performance even at a low temperature.

17 Claims, 1 Drawing Sheet

ALKALINE DEGREASING SOLUTION COMPRISING AMINE OXIDES

This application is a continuation of application Ser. No. 699,164, filed Feb. 7, 1985 now abandoned.

BACKGROUND OF THE INVENTION

1. Field of the Invention

This invention generally relates to an aqueous solution of an alkaline degreasing agent, (hereinafter referred to as "an alkaline degreasing solution"), employed for removing oil and soil from surfaces of a steel sheet, galvanized steel sheet or galvannealed steel sheet, and an alkaline degreasing agent employed for making up and replenishing the alkaline degreasing solution. It relates more particularly to an alkaline degreasing solution with a low foaming tendency which are effective in a metal surface cleaning especially through a spray degreasing or immersion degreasing at a relatively low temperature such as 40° C., provided prior to a chemical conversion treatment and paint coating therefor.

2. Description of the Prior Art

Conventionally, metal products made of the aforementioned metals are generally treated by the following steps prior to paint coating:

surface cleaning (degreasing)
↓
water rinsing (multistage method)
↓
surface conditioning
↓
chemical conversion treatment
↓
water rinsing (multistage method)
↓
deionized water rinsing
↓
drying off
↓
paint coating; anionic electrocoating
cationic electrocoating
electrostatic coating
powder coating
spray or brush coating
etc.

The alkaline degreasing solutions and alkaline degreasing agents employed for cleaning metal surfaces have been introduced in various literature.

The alkaline degreasing agents are generally a powdery mixture of alkaline builders (alkaline compounds which are a main component of an alkaline degreasing agent), surface active agents, and defoaming agents.

The alkaline degreasing solution in which the alkaline degreasing agent is dissolved is employed for removing oil and soil from metal surfaces by means of a spray cleaning or immersion cleaning, the temperature of the solution employed for the cleaning generally being 40°-70° C. and degreasing time 1-10 minutes.

Recently, an interest has been increasingly generated in the alkaline degreasing agents and alkaline degreasing solutions utilized at a low temperature, with a view to energy conservation. The alkaline degreasing agents made for this purpose, however, have had the following deficiencies when they have been used for cleaning surfaces of metals (to be treated):

a. excessive foaming during degreasing.

b. low foaming but poor degreasing effects.

In the case that an alkaline degreasing solution excessively foams;

1. The foam may spill out of a degreasing tank and cause a loss of the alkaline degreasing solution in a large quantity, and 2. The foam may enter the inside of a box section of the metal products or of a box shaped metal product at the outset of an immersion degreasing. The foam left inside, due to the above shapes of the metal products, hinders the alkaline degreasing solution from contacting with inner surfaces thereof, and the foam whereby causes an incomplete degreasing on the inner surfaces.

SUMMARY OF THE INVENTION

A principal object of the invention is to provide an alkaline degreasing solution and alkaline degreasing agent, which improve degreasing effects without suppressing defoaming power so as to solve particularly the aforementioned problem b regarding the alkaline degreasing solution and alkaline degreasing agent used at a low temperature.

Another object of the present invenion is to provide an alkaline degreasing solution and an alkaline degreasing agent with a low foaming tendency which are effective in a metal surface cleaning provided prior to a chemical conversion treatment and paint coating therefore, specially through a spray degreasing or immersion degreasing.

DETAILED DESCRIPTION OF THE INVENTIONS

Figure 1:
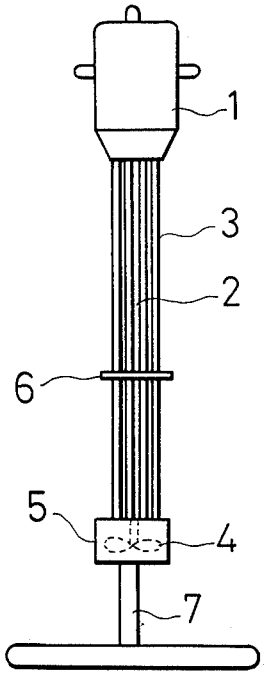
FIG. 1 is a front view of the homomixer (T. K. Homomixer, TYPE: HU-M).

The essential constituent for the alkaline degreasing solution and alkaline degreasing agent of the the present invention is a compound, a nonionic surface active agent, whose structural formula can be described as follows;

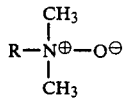

R shown in the above structural formula represents aliphatic hydrocarbon group as hydrophobic group having the number of carbon atoms 12-22. The R may be an alkyl such as a dodecyl group ($C_{12}H_{25}$—) or a octadecyl group ($C_{18}H_{37}$—), or a combination thereof. Further the R may be of a synthetic, an extract or a derivative of natural materials, and either a linear or a branched hydrocarbon group. In addition, said R may be such an cis-9-Octadecenyl group that has an olefinic unsaturated combination, though the R is composed mainly of a saturated hydrocarbon group generally not containing an olefinic unsaturated group.

The R may be alkyl group obtained by hydrogenation of fatty acid, which can be a component of at least one of such natural vegetable oils as coconut oil, soybean oil, palm oil, sesami oil, sunflower oil, safflower oil and olive oil or such animal oils as lard and beef tallow. The R is mainly of saturated hydrocarbon group, however it may contain unsaturated hydrocarbon depending upon the reduction conditions with hydrogen or others employed therefore.

The content of the compound in the alkaline degreasing solution or in alkaline degreasing agent of the invention, shall be limited to 0.1–2 g/L (one liter of alkaline degreasing solution), and more preferably 0.1–1 g/L. The degreasing improvement effect of the degreasing performance of the compound, namely the dimethylamine oxide, is negligible in the case that the alkyl dimethylamine content in the present alkaline degreasing solution is less than 0.1 g/L, particularly at a low temperature, below 40 C. A satisfactry effect thereof can be obtained within the range of 0.1–1 g/L. Further the content of the compound in the present alkaline degreasing solution is generally maintained within the range of 0.1–1 g/L, for the improvement effect thereof does not ameliorate in proportion to the amount thereof added up to 2 g/L. Therefore, the maximum content of the compound in the present alkaline degreasing solution should be 2 g/L.

The dimethylamine oxide itself (apart from other ingredients) may be added into a degreasing tank. However, in order to maintain 0.1–2 g of alkyl dimethylamine oxide content per one liter of the alkaline degreasing solution, preferably 0.1–1 g/L, it is prudent to mix the dimethylamine oxide with the other ingredients during the manufacturing stage thereof. The amount of alkyl dimethylamine oxide mixed in the alkaline degreasing agent should be 1–5% thereof.

Major ingredients, excluding the aforementioned dimethylamine oxide, contained in the alkaline degreasing solution and alkaline degreasing agent of the present invention are;

(a) other surface active agents, (b) alkali builders, and (c) defoaming agents, which are to be explained hereunder. In addition, said (a) and (c) are not necessarily contained in the alkaline degreasing agent of the invention, and may be added thereto as other agents, when necessary.

(A) OTHER SURFACE ACTIVE AGENTS

Other surface active agents are not limited by a specific ionic state, (i.e., nonionic, anionic, ampholytic, or cationic). Any surface active agent with the ionic state mentioned above may be employed therefor. However, the prefarable surface active agent therefor should be a nonionic surface active agent (HLB 11–15, cloud point below 40° C., for example) or a mixture comprising a nonionic surface active agent and an anionic surface active agent.

As for the nonionic surface active agent, polyoxyethylene alkylphenylether (alkylphenol type), polyoxyethylene fatty acid ester (higher alchol), etc., and preferably polyoxyethylene nonylphenylether (HLB approximately 12.6) may be employed.

As for the anionic surface active agent, -olefinic sulfonate (—olefin type), alkyl sulfonate (normal paraffine type), alkyl sulfate, and alkylether sulfate (higher alchol type), linear alkyl sulfonate (linear alkyl benzene type), and alkali salts of fatty acid, and prefarably linear alkyl sulfonic acid and -olefinic sulfonate may be employed.

(B) ALKALINE BUILDER

The alkaline builder employed for the alkaline degreasing solution and alkaline degreasing agent of the present invention shall not be specified in type. Alkaline builders may be generally classified into three types, namely, the strong alkaline type composed mainly of sodium silicate or trisodium phosphate and/or caustic soda, medium alkaline type composed of one or more than one of the following; disodium phosphate, sodium pyrophosphate, sodium carbonate, etc., and mild alkaline type composed of disodium phosphate, sodium bicarbonate, sodium tripolyphosphate, sodium sesquicarbonate, etc.. Any alkaline builder of the above types may be employed therefor.

(C) DEFOAMING AGENT

The defoaming agent employed for the alkaline degreasing solution and alkaline degreasing agent of the present invention shall not be specified in type.

The present alkaline degreasing solution can improve degreasing effects without lowering its defoaming performance even at a low temperature, such as 40° C., due to the dimethylamine oxide contained therein as a component of the surface active agents therefor at a concentration 0.1–2 g/L.

The present alkaline degreasing solution can clean metal surfaces to be treated to a satisfactory degree, maintaining its defoaming performance, in approximately one minute in such case that a spray method is employed therefor and in approximately two minutes by means of an immersion method, at a low temperature, about 40° C.

Furthermore, the present alkaline degreasing solution can improve degreasing effects at a high temperature, above about 40° C., maintaining better defoaming performance in comparison with conventional alkaline degreasing solutions.

The present alkaline degreasing solution will show the above advantages more securely in the case that the hydrocarbon group of the dimethylamine oxide mixed therein is hydrogen reduced hydrocarbon obtained from a fatty acid composing natural vegetable oil such as palm oil or an animal oil, for the hydrocarbon group shall be of a straight chain as well as mixture of various groups.

The alkaline degreasing solution and alkaline degreasing agent of the present invention may be added in with such surface active agents as nonionic surface active agents or a mixture comprising nonionic and anionic surface active agents in addition to the aforementioned to obtain the above advantages more securely.

The alkaline degreasing agent of the invention may be added in with the dimethylamine oxide along with alkali builders, said other surface active agents, defoaming agents, etc. to eliminate the troublesome task of adding separate alkyl dimethylamine oxide to an alkaline degreasing solution.

EMBODIMENTS OF THE INVENTION AND COMPARATIVE EXAMPLES

The present invention shall be explained in detail, with the embodiments of the invention being compared with comparative examples as follows:

(1) Alkaline Degreasing Agent

The alkaline degreasing agents, embodiments 1–6 and comparative examples 1–4 shown in Table 1, had been prepared as prescribed by means of a kneader utilized for an adequate mixing thereof.

The commercial products prescribed for the mixing materials are as follows:

| MATERIALS | MAKER | CONTENTS |
|---|---|---|
| PERCOLENE Z | Nihon Parkerizing Co., Ltd. | surface conditioning agent including titanium |
| SOFT DETERGENT 60 | Lion Fats and Fatty Oils Co., Ltd. | linear alkyl benzene sodium sulfonate (anionic) |
| SURFYNOL 104 | Nissin Chemical Industry Co., Ltd. | nonionic surfactant |
| AROMOX DMC-W | Lion Fats and Fatty Oils Co., Ltd. | alkyl dimethylamine oxide |
| COLORIN DF | Sanyo Kasei Industry Co., Ltd. | defoaming agent |
| SN DEFORMER 5013 | San Nopco Ltd. | defoaming agent |

(2) Alkaline Degreasing Solution 18 g of the aforementioned alkaline degreasing agents were respectively solved in water so as to make one liter of an alkaline degreasing solution.

The alkaline degreasing agent will not be solved completely due to PERCOLENE Z mixed therein, and the alkaline degreasing solution, therefore will shown slightly cloudy.

(3) Test Panel and Rust Preventing Oil Application

A steel sheet was selected for the test panel to be applied with a rust preventing oil. A a galvanized steel sheet and a galvannealed steel sheet may be applied with a rust preventing oil. However, the rust preventing oil applied on a galvanized steel sheet and galvannealed steel sheet are relatively easy to be degreased. Thus, a steel sheet was selected for the test panel.

Test panel: JIS—G—3141, SPCC

Rust preventing oil: DAPHNE OIL COAT (Idemitsu Kosan Co., Ltd.)

Rust preventing oil application:

The above rust peventing oil was applied on the surfaces of the test panels at 1–2 g/m$^2$ by means of a roll coater after the test panels had been cleaned with trichloroethylene.

Test panel A:

The test panel which was left at a room temperature for seven days after the application of the rust preventing oil as set forth above.

Test panel B:

The test panel which was left inside a high-temperature high-humidity cabinet at a temperature 60° C.±1° C. and relative humidity 95±2%.

(4) Degreasing Power Test

A test was conducted to evaluate degreasing performance of the alkaline degreasing solutions. Each alkaline degreasing solution was heated to be maintained at a temperature of 40 C.+1 C. Three test panels were immersed in each alkaline degreasing solution for two minutes, being placed therein separately so that they do not touch with each other, then were taken out of the solution to be rinsed off with a water spray for 30 seconds, and then were placed vertically at a room temperature for 60 seconds. Thereupon, water-wetted areas on the test panels were measured to evaluate degreasing performance of the alkaline degreasing solutions.

EXAMPLE

100—100% water-wetted. (degreasing performance: excellent)

50—50% water-wetted. (degreasing performance: poor)

The alkaline degreasing solutions, mixed with the abovementioned rust preventing oil were employed for the degreasing test. 2–3 g of the rust preventing oil was added to one liter of each alkaline degreasing solution to be mixed therein by means of a homomixer (T. K. HOMOMIXER; TYPE HU-M) shown in FIG. 1 at 10,000 rpm for 20 minutes.

(5) Foaming Test

Figure 2:
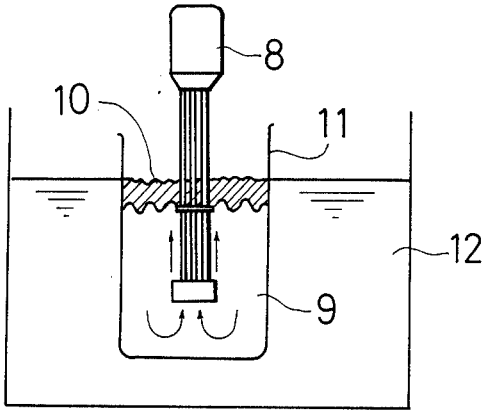
FIG. 2 is a front view of the apparatus for foaming test.

A foaming test was conducted, employing the testing apparatus shown in FIG. 2 in order to simulate the pump mixing at an actual immersion degreasing line, as follows:

2,000 ml of an alkaline degreasing solution 9 was provided in a 3-liter tall-beaker 11 (inside diameter 130 mm, height 300 mm) and then was placed in a thermostatic bath 12 to be maintained at a temperature of 40° C.±1° C. A turbine shaft 2 of a homomixer 8 was placed vertically in the tall beaker 11 at the center portion of the side-wall thereof. The bottom end portion of a stater 5 (a cylindrical ring encircling a turbine 4) was set at 60 mm above the bottom of the tall beaker 11. A plate 6, movable vertically, was moved along a supporting bar 3 to set the top side thereof with the same kevek of surface of the alkaline degreasing solution surface. The alkaline degreasing solution, maintained at a temperature of 40° C.±1° C., was agitated by means of the turbine 4 of the homomixer 8 at 10,000 rpm for 20 minutes to be pushed upward through the stater 5 to collide against the plate 6 to foam.

The thickness of the foam accumulated on the surface of the alkaline degreasing solution was measured in mm unit to evaluate the foaming tendency thereof after 30 seconds the homomixer 8 had stopped its rotating motion. The homomixer 8 was promptly taken out of the tall-beaker 11 after the alkaline degreasing solution had been agitated.

Embodiments of the invention are shown in Tables 1 and 2. Table 1 shows various example formula for alkaline degreasing agents in accordance with the present invention. Table 2 shows test results of various alkaline degreasing solutions prepared from the alkaline degreasing agents.

The results of comparisons between the embodiments 1–6 and comparative examples 1–4 can be summerized as follows:

a. Degreasing Test

The degreasing test proved a superiority of the embodiments over the comparative examples. Each alkaline degreasing solution of the embodiments and comparative examples were maintained at a temperature of 40° C.±1° C. and wherein test panels A and B were respectively immersed for 2 minutes. In the case that the rust preventing oil was not added to the alkaline degreasing solutions, the embodiments showed slightly better results in comparison with the comparative examples. Whereas, in the case that the rust preventing oil was added to the alkaline degreasing solutions at mixture rates of 2 g/L and 3 g/L, the embodiments clearly showed better test results over the comparative examples at both mixture rates. The addition of the rust preventing oil to the embodiments up to 3 g/L caused a minor decrease if any in their degreasing performance, while the decrease in the degreasing performance of the comparative examples caused by the rust preventing oil added up tp 3 g/L was apparently noticeable.

b. Foaming Test

A forming test to compare the embodiments with the comparative examples as to their foaming shows the superiority of the embodiments. The embodiments with the rust preventing oil added therein showed excellent ( ) results. Some of the embodiments without the rust preventing oil showed good ( ) results. The comparative examples, with the rust preventing oil added therein showed various results, excellent ( ) to poor (X). The comparative examples, without the rust preventing oil showed a high foaming tendency. Furthermore, the embodiments also showed better results in individual comparisons thereof with the comparative examples.

1. An aqueous solution of an alkaline degreasing agent comprising at least inorganic alkaline builders, surface active agents and a defoaming agent comprising kerosine, for cleaning metal surfaces, in which said surface active agents consist of two nonionic and one anionic surface active agents, wherein one nonionic comprises an alkyl dimethylamine oxide having the structural formula

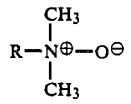

wherein R is a hydrocarbon group having the number of carbon atoms in a range from 12 to 22, and the other nonionic comprises a polyoxyalkylene alkylphenylether or a polyoxyalkylene fatty acid ester;

TABLE 1

| COMPONENT (wt %) | EMBODIMENTS 1 | 2 | 3 | 4 | 5 | 6 | COMPARATIVE EXAMPLE 1 | 2 | 3 | 4 |
|---|---|---|---|---|---|---|---|---|---|---|
| ALKALINE BUILDER | | | | | | | | | | |
| sodium carbonate | 22.5 | 21.9 | 20.9 | 21.2 | 21.2 | 21.2 | 21.2 | 21.9 | 22.5 | 22.5 |
| sodium bicarbonate | 19.0 | 18.5 | 17.7 | 17.9 | 17.9 | 17.9 | 17.9 | 18.5 | 19.0 | 19.0 |
| disodium phosphate | 25.6 | 25.0 | 23.9 | 24.3 | 24.3 | 24.3 | 24.3 | 25.0 | 25.6 | 25.6 |
| trisodium phosphate | 5.1 | 5.0 | 4.8 | 4.9 | 4.9 | 4.8 | 4.9 | 5.0 | 5.1 | 5.1 |
| sodium pyrophosphate | 2.1 | 2.0 | 1.9 | 1.9 | 1.9 | 1.9 | 1.9 | 2.0 | 2.1 | 2.1 |
| sodium nitrite | 10.3 | 10.0 | 9.6 | 9.7 | 9.7 | 9.7 | 9.7 | 10.0 | 10.3 | 10.3 |
| PARCOLENE Z | 5.1 | 5.0 | 4.8 | 4.9 | 4.9 | 4.8 | 4.9 | 5.0 | 5.1 | 5.1 |
| SURFACE ACTIVE AGENT | | | | | | | | | | |
| polyoxyethylene nonylphenylether(nonionic) (ethylene oxide: 8.6 mol, HLB: 12.6) | 4.6 | 4.6 | 4.6 | 6.7 | 6.7 | 4.6 | 8.7 | 4.6 | 5.6 | 5.6 |
| SOFT DETERGENT 60 | | | | | 1.0 | 2.0 | | 2.5 | | |
| SURFYNOL 104 | | | | 1.8 | 1.8 | | 1.8 | | | |
| AROMOX DMC-W | 1.0 | 2.5 | 5.0 | 2.0 | 1.0 | 2.0 | | | | |
| DEFOAMING AGENT | | | | | | | | | | |
| COLORIN DF | | | | | | | | | 2.8 | |
| SN DEFOAMER 5013 | 2.8 | 3.6 | 4.9 | 2.8 | 2.8 | 4.9 | 2.8 | 3.6 | | 2.8 |
| kerosine | 1.9 | 1.9 | 1.9 | 1.9 | 1.9 | 1.9 | 1.9 | 1.9 | 1.9 | 1.9 |
| Total | 100 | 100 | 100 | 100 | 100 | 100 | 100 | 100 | 100 | 100 |

TABLE 2

| | ADDITION OF RUST PREVENTIVE OIL | | | | | | | | | | | | | | | | | |
|---|---|---|---|---|---|---|---|---|---|---|---|---|---|---|---|---|---|---|
| | 0 | | | | | | | 2 g/L | | | | | | | 3 g/L | | | |
| | DEGREASING PERFORMANCE | | | | | | DE-FOAM-ING | DEGREASING PERFORMANCE | | | | | | DE-FOAM-ING | DEGREASING PERFORMANCE | | | | | | DE-FOAM-ING |
| | TEST PANEL A (%) | | | TEST PANEL B (%) | | | PER-FOR-MANCE (mm) | TEST PANEL A (%) | | | TEST PANEL B (%) | | | PER-FOR-MANCE (mm) | TEST PANEL A (%) | | | TEST PANEL B (%) | | | PER-FOR-MANCE (mm) |
| EMBODI-MENTS | | | | | | | | | | | | | | | | | | | | | |
| 1 | 100 | 100 | 100 | 100 | 95 | 100 | 0( ) | 100 | 95 | 100 | 95 | 90 | 95 | 0( ) | 95 | 90 | 90 | 80 | 90 | 80 | 0( ) |
| 2 | 100 | 95 | 100 | 100 | 95 | 95 | 0( ) | 100 | 100 | 95 | 95 | 100 | 95 | 0( ) | 100 | 95 | 95 | 95 | 90 | 100 | 0( ) |
| 3 | 100 | 100 | 100 | 95 | 100 | 100 | 0–3( ) | 100 | 100 | 100 | 100 | 100 | 95 | 0( ) | 100 | 100 | 100 | 100 | 100 | 100 | 0( ) |
| 4 | 100 | 100 | 100 | 100 | 95 | 100 | 0–3( ) | 100 | 100 | 100 | 100 | 95 | 95 | 0( ) | 100 | 100 | 100 | 95 | 95 | 95 | 0( ) |
| 5 | 100 | 100 | 100 | 100 | 100 | 100 | 0–3( ) | 100 | 100 | 100 | 100 | 95 | 100 | 0( ) | 100 | 100 | 100 | 100 | 100 | 100 | 0( ) |
| 6 | 100 | 100 | 100 | 95 | 100 | 100 | 0–3( ) | 100 | 100 | 100 | 100 | 95 | 100 | 0( ) | 100 | 100 | 95 | 100 | 95 | 100 | 0( ) |
| COMPARA-TIVE EXAMPLE | | | | | | | | | | | | | | | | | | | | | |
| 1 | 90 | 90 | 90 | 90 | 85 | 90 | 20(X) | 90 | 85 | 85 | 70 | 70 | 75 | 12(X) | 70 | 60 | 60 | 50 | 60 | 50 | 8(Δ) |
| 2 | 90 | 90 | 90 | 90 | 90 | 95 | 5( ) | 70 | 80 | 80 | 60 | 60 | 60 | 0( ) | 60 | 60 | 60 | 50 | 40 | 50 | 0( ) |
| 3 | 95 | 100 | 100 | 95 | 100 | 95 | 5( ) | 90 | 95 | 90 | 90 | 90 | 90 | 4( ) | 80 | 75 | 80 | 75 | 70 | 70 | 0( ) |
| 4 | 100 | 95 | 100 | 95 | 95 | 95 | 5( ) | 95 | 90 | 90 | 90 | 90 | 90 | 0( ) | 90 | 90 | 90 | 80 | 80 | 80 | 0( ) |

: Excellent
: Good
Δ: Fair
X: Poor

What is claimed is:

the composition ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said nonionic surface active agent other than said amine oxide is 4.6 to 6.7 weight percent, 4.7 to 6.8 weight percent of said defoaming agent, and the remainder being said inorganic alkaline builders; and in said alkaline degreasing aqueous solution prepared by adding water to said composition, the content of said alkyl dimethylamine oxide being 0.1 to 2 gram per one liter of said aqueous solution.

2. An aqueous solution of an alkaline degreasing agent as claimed in claim 1, wherein said hydrocarbon group is an alkyl group.

3. An aqueous solution of an alkaline degreasing agent as claimed in claim 1, wherein said hydrocarbon group is one obtained by hydrogenation of fatty acid of a natural vegetable oil.

4. An aqueous solution of an alkaline degreasing agent as claimed in claim 3, wherein said natural vegetable oil is one selected from the group consisted of coconut oil, soybean oil, palm oil, sesami oil, sunflower oil, safflower oil, olive oil and the mixture thereof.

5. An aqueous solution of an alkaline degreasing agent as claimed in claim 1, wherein said hydrocarbon group is one obtained by hydrogenation of fatty acid of an animal oil.

6. An aqueous solution of an alkaline degreasing agent as claimed in claim 1, wherein said hydrocarbon group is one obtained by polymerization of ethylene monomer or a by decomposition of paraffin.

7. An aqueous solution of an alkaline degreasing agent as claimed in claim 1, wherein the content of said alkyl dimethylamine oxide is 0.1 to 1 g per one liter of said aqueous solution.

8. An alkaline degreasing agent for making and replenishing an alkaline degreasing solution for cleaning of metal surface; comprising at least inorganic alkaline builders, surface active agents and a defoaming agent comprising kerosine, in which said surface active agents consist of two nonionic and one anionic surface active agents, wherein one nonionic comprises an alkyl dimethylamine oxide having the structural formula

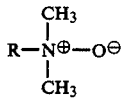

wherein R is a hydrocarbon group having the number of carbon atoms in a range from 12 to 22, and the other nonionic comprises a polyoxyalkylene alkylphenylether or a polyoxyalkylene fatty acid ester;

the composition ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said nonionic surface active agent other than said amine oxide is 4.6 to 6.7 weight percent, 4.7 to 6.8 weight percent of said defoaming agent, and the remainder being said inorganic alkaline builders.

9. An alkaline degreasing agent as claimed in claim 8, wherein said hydrocarbon group is an alkyl group.

10. An alkaline degreasing agent as claimed in claim 8, wherein said hydrocarbon group is one obtained by hydrogenation of fatty acid of a natural vegetable oil.

11. An alkaline degreasing agent as claimed in claim 8, wherein said hydrocarbon group is one obtained by hydrogenation of fatty acid of an animal oil.

12. An aqueous solution of an alkaline degreasing agent comprising at least inorganic alkaline builders, surface active agents and a defoaming agent comprising kerosine, for cleaning metal surfaces, in which said surface active agents consist of two nonionic surface active agents, wherein one nonionic comprises an alkyl dimethylamine oxide having the structural formula

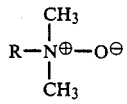

wherein R is a hydrocarbon group having the number of carbon atoms in a range from 12 to 22 and the other nonionic comprises a polyoxyalkylene alkylphenylether or a polyoxyalkylene fatty acid ester;

the composition ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said polyoxyalkylene alkylphenylether or polyoxyalkylene fatty acid ester is 4.6 to 6.7 weight percent, 4.7 to 6.8 weight percent of said defoaming agent, and the remainder being said inorganic alkaline builders; and in said alkaline degreasing aqueous solution prepared by adding water to said composition, the content of said alkyl dimethylamine oxide being 0.1 to 2 grams per one liter of said aqueous solution.

13. An alkaline degreasing agent for making and replenishing an alkaline degreasing solution for cleaning of metal surface; comprising at least inorganic alkaline builders, surface active agents and a defoaming agent comprising kerosine, in which said surface active agents consist of two nonionic surface active agents, wherein one nonionic comprises an alkyl dimethylamine oxide having the structural formula

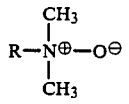

wherein R is a hydrocarbon group having the number of carbon atoms in a range from 12 to 22, and the other nonionic comprises a polyoxyalkylene alkylphenylether or a polyoxyalkylene fatty acid ester;

the composition ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said polyoxyalkylene alkylphenylether or polyoxyalkylene fatty acid ester is 4.6 to 6.7 weight percent, 4.7 to 6.8 weight percent of said defoaming agent, and the remainder being said inorganic alkaline builders.

14. An aqueous solution of an alkaline degreasing agent comprising at least inorganic alkaline builders, surface active agents and a defoaming agent comprising kerosine, for cleaning metal surfaces, in which said surface active agents consist of three nonionic and one anionic surface active agents, wherein one nonionic comprises an alkyl dimethylamine oxide having the structural formula

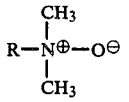

wherein R is a hydrocarbon group having the number of carbon atoms in a range from 12 to 22 and the other nonionic comprises a polyoxyalkylene alkylphenylether or a polyoxyalkylene fatty acid ester and another nonionic is a butyne diol nonionic surface active agent having the structural formula $$R_6—C(CH_3)(OH)C{\equiv}C—C(CH_3)(OH)—R_6$$

wherein $R_6$ is an alkyl group having 4 to 6 carbon atoms.

15. An alkaline degreasing agent for making and replenishing an alkaline degreasing solution for cleaning of metal surface; comprising at least inorganic alkaline builders, surface active agents and a defoaming agent comprising kerosine, in which said surface active agents consist of three nonionic and one anionic surface active agents, wherein one nonionic comprises an alkyl dimethylamine oxide having the structural formula

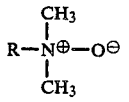

wherein R is a hydrocarbon group having the number of carbon atoms in a range from 12 to 22, and the other nonionic comprises a polyoxyalkylene alkylphenylether or a polyoxyalkylene fatty acid ester and another nonionic is a butyne diol nonionic surface active agent having the structural formula $$R_6—C(CH_3)(OH)C{\equiv}C—C(CH_3)(OH)—R_6$$

wherein $R_6$ is an alkyl group having 4 to 6 carbon atoms;

the composition ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said nonionic surface active agent other than said amine oxide is 4.6 to 6.7 weight percent, 4.7 to 6.8 weight percent of said defoaming agent, and the remainder being said inorganic alkaline builders.

16. An aqueous solution of an alkaline degreasing agent comprising at least inorganic alkaline builders, surface active agents and a defoaming agent comprising kerosine, for cleaning metal surfaces, in which said surface active agents consist of three nonionic surface active agents, wherein one nonionic comprises an alkyl dimethylamine oxide having the structural formula

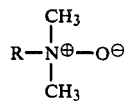

wherein R is a hydrocarbon group having the number of carbon atoms in a range from 12 to 22 and the other nonionic comprises a polyoxyalkylene alkylphenylether or a polyoxyalkylene fatty acid ester and another nonionic is a butyne diol nonionic surface active agent having the structural formula $$R_6—C(CH_3)(OH)C{\equiv}C—C(CH_3)(OH)—R_6$$

wherein $R_6$ is an alkyl group having 4 to 6 carbon atoms;

the composiion ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said polyoxyalkylene alkylphenylether or polyoxyalkylene fatty acid ester is 4.6 to 6.7 weight percent, 4.7 to 6.8 weight percent of said defoaming agent and the remainder being said inorganic alkaline builders; and in said alkaline degreasing aqueous solution prepared by adding water to said composition, the content of said alkyl dimethylamine oxide being 0.1 to 2 gram per one liter of said aqueous solution.

17. An alkaline degreasing agent for making and replenishing an alkaline degreasing solution for cleaning of metal surface; comprising at least inorganic alkaline builders, surface active agents and a defoaming agent comprising kerosine, in which said surface active agents consist of three nonionic surface active agents, wherein one nonionic comprises an alkyl dimethylamine oxide having the structural formula

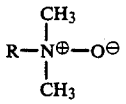

wherein R is a hydrocarbon group having the number of carbon atoms in a range from 12 to 22, and the other nonionic comprises a polyoxyalkylene alkylphenylether or a polyoxyalkylene fatty acid ester, and another nonionic is a butyne diol nonionic surface active agent having the structural formula $$R_6—C(CH_3)(OH)C{\equiv}C—C(CH_3)(OH)—R_6$$

wherein $R_6$ is an alkyl group having 4 to 6 carbon atoms;

the composition ratios of said inorganic alkaline builders, defoaming agent and nonionic surface active agents being as follows, where all of the solid portions thereof are determined in weight percent:

5.6 to 11.7 weight percent of said nonionic surface active agents, in which said amine oxide is 1 to 5 weight percent and said polyoxyalkylene alkylphenylether or polyoxyalkylene fatty acid ester is 4.6 to 6.7 weight percent, 4.7 to 6.8 weight percent of said defoaming agent, and the remainder being said inorganic alkaline builders.

* * * * *